US007033204B1

(12) United States Patent
Wang

(10) Patent No.: US 7,033,204 B1
(45) Date of Patent: Apr. 25, 2006

(54) LOCKING/UNLOCKING MECHANISM FOR MOBILE RACK

(76) Inventor: Dong-Yang Wang, No. 56, Renhe E. St., Dasi Township, Taoyuan County 335 (TW)

( * ) Notice: Subject to any disclaimer, the term of this patent is extended or adjusted under 35 U.S.C. 154(b) by 0 days.

(21) Appl. No.: 11/171,390

(22) Filed: Jul. 1, 2005

(30) Foreign Application Priority Data

Dec. 16, 2004 (TW) ..... 93220267 U

(51) Int. Cl.
*H01R 13/62* (2006.01)

(52) U.S. Cl. ..... 439/372; 439/352; 385/147

(58) Field of Classification Search ..... 439/352, 439/372, 489; 385/50–52, 88–92, 139, 147
See application file for complete search history.

(56) References Cited

U.S. PATENT DOCUMENTS 6,430,053 B1 * 8/2002 Peterson et al. ..... 361/728
6,439,918 B1 * 8/2002 Togami et al. ..... 439/372
6,731,510 B1 * 5/2004 Hwang et al. ..... 361/754
6,744,963 B1 * 6/2004 Hwang ..... 385/139
6,778,399 B1 * 8/2004 Medina et al. ..... 361/729
6,786,653 B1 * 9/2004 Hwang et al. ..... 385/92
6,890,206 B1 * 5/2005 Distad et al. ..... 439/372
6,945,809 B1 * 9/2005 Ishigami et al. ..... 439/372
2005/0208822 A1 * 9/2005 Ishigami et al. ..... 439/372

* cited by examiner

*Primary Examiner*—P. Austin Bradley
*Assistant Examiner*—Larisa Tsukerman
(74) *Attorney, Agent, or Firm*—Troxell Law Office, PLLC

(57) ABSTRACT

A locking/unlocking mechanism for mobile rack is disclosed to include a sleeve, which has a retaining spring plate with a retaining hole, and a sliding member formed of a base, a movable holder plate, a locating plate and a handle and insertable into the sleeve, the base of the sliding member having a raised portion, which engages the retaining hole of the retaining spring plate to lock the sliding member to the sleeve, the handle is pivotally coupled to the base by the movable holder plate and the locating plate and turnable relative to the base to force the movable holder plate and to further cause the base to disengage the raised portion from the retaining hole of the retaining spring plate to unlock the sliding member from the sleeve.

4 Claims, 4 Drawing Sheets

LOCKING/UNLOCKING MECHANISM FOR MOBILE RACK

BACKGROUND OF THE INVENTION

1. Field of the Invention

The present invention relates generally to a mobile rack and more specifically, to a locking/unlocking mechanism for mobile rack.

2. Description of the Related Art

Mobile racks or like designs have been intensively used in different products, for example, drawers in a desk. Many electronic products are made in the form of a mobile rack, for example, mobile hard diskdrive. A mobile rack is generally comprised of an outer sleeve member and an inner sliding member detachably insertable into the outer sleeve member. After insertion of the inner sliding member into the outer sleeve member, the inner sliding member must be locked to the outer sleeve member to prevent falling from the outer sleeve member. The locking and unlocking mechanism between the inner sliding member and the outer sleeve member must be easy to operate so that the user can replace the inner sliding member conveniently when desired.

Further, photoelectric converting technology is quite important in information transmission. Photoelectric converting connectors are important members for the application of photoelectric converting technology. Regular photoelectric converting connector modules are commonly made in a mobile form like a mobile rack. Therefore, the locking/unlocking structure of a mobile photoelectric converting connector module is also important.

SUMMARY OF THE INVENTION

The present invention has been accomplished under the circumstances in view. According to the present invention, the locking/unlocking mechanism comprises a sleeve member, the sleeve member comprising a receiving open chamber longitudinally extending through front and rear sides thereof, and a suspending retaining spring plate disposed at a bottom side thereof, the retaining spring plate having a center retaining hole and a front free end terminating in a beveled guide portion; a sliding member insertable into the receiving open chamber of the sleeve member, the sliding member comprising a base, a handle, a movable holder plate, and a locating plate, the base having a plurality of bottom mounting rods fastened to the locating plate and a raised portion protruding from a bottom wall thereof and adapted to engage the retaining hole of the retaining spring plate of the sleeve member, the handle having a loop-like shape and a V-shaped protruding portion disposed at a bottom side thereof on the middle, the movable holder plate having a hole adapted to accommodate the V-shaped protruding portion of the handle, a beveled guide portion adapted to match the beveled guide portion of the retaining spring plate of the sleeve member, and a sliding groove adapted to accommodate the handle, the locating plate having two mounting holes respectively fastened to the bottom mounting rods of the, a chamber adapted to accommodate the movable holder plate, two side arms symmetrically disposed at two opposite lateral sides, and two locating grooves respectively formed in the side arms for the positioning of the handle. When inserted the sliding member into the sleeve, the raised portion of the base of the sliding member is engaged into the retaining hole of the retaining spring plate of the sleeve member to lock the sliding member to the sleeve member; when the user turned the handle outwardly downwards from the sliding member, the V-shaped protruding portion is forced against the movable holder plate, thereby causing the raised portion of the base of the sliding member to be disengaged from the retaining hole of the retaining spring plate of the sleeve member to unlock the sliding member from the sleeve member.

DETAILED DESCRIPTION OF THE INVENTION

Figure 1:
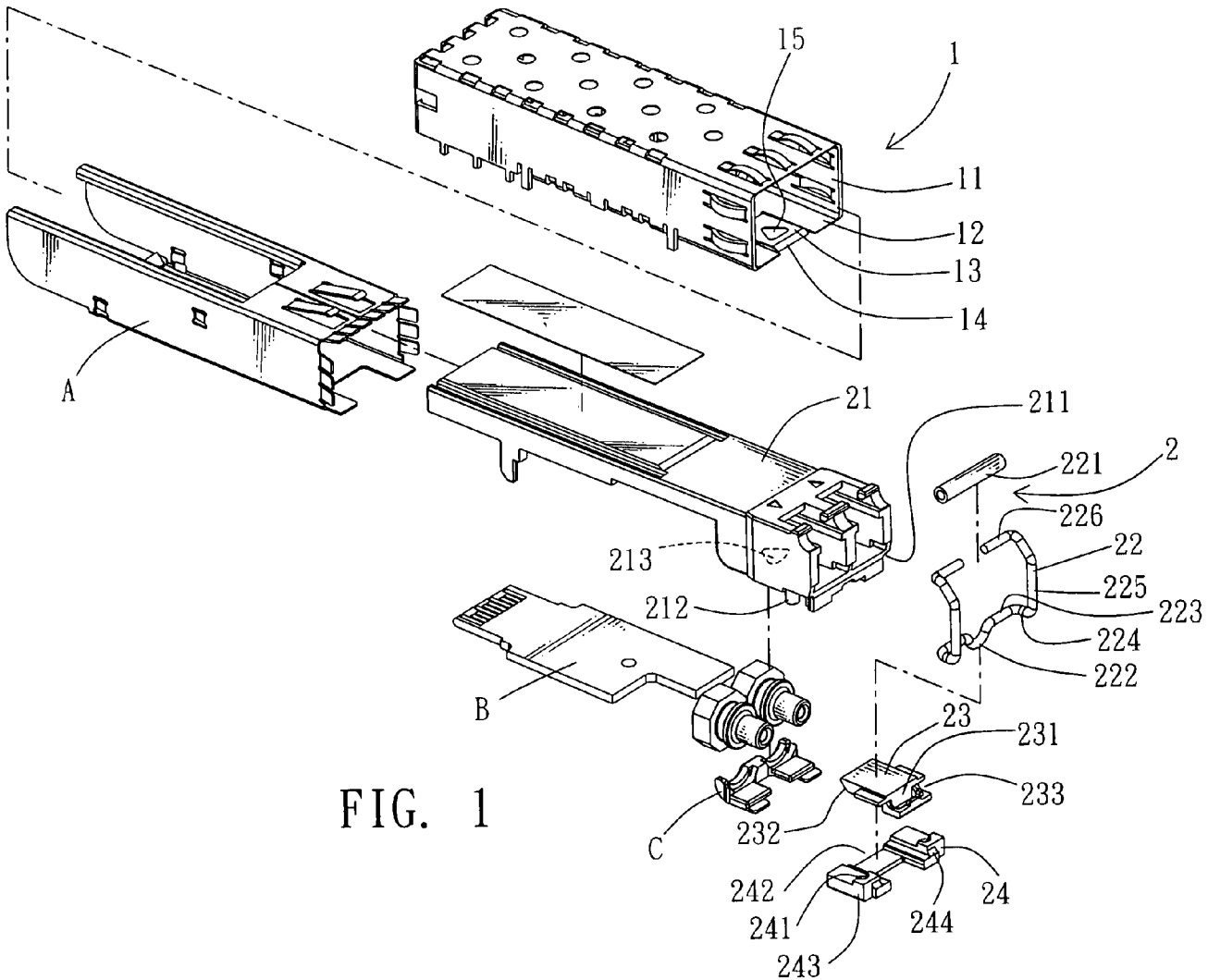
FIG. 1 is an exploded view of the preferred embodiment of the present invention.
Figure 2:
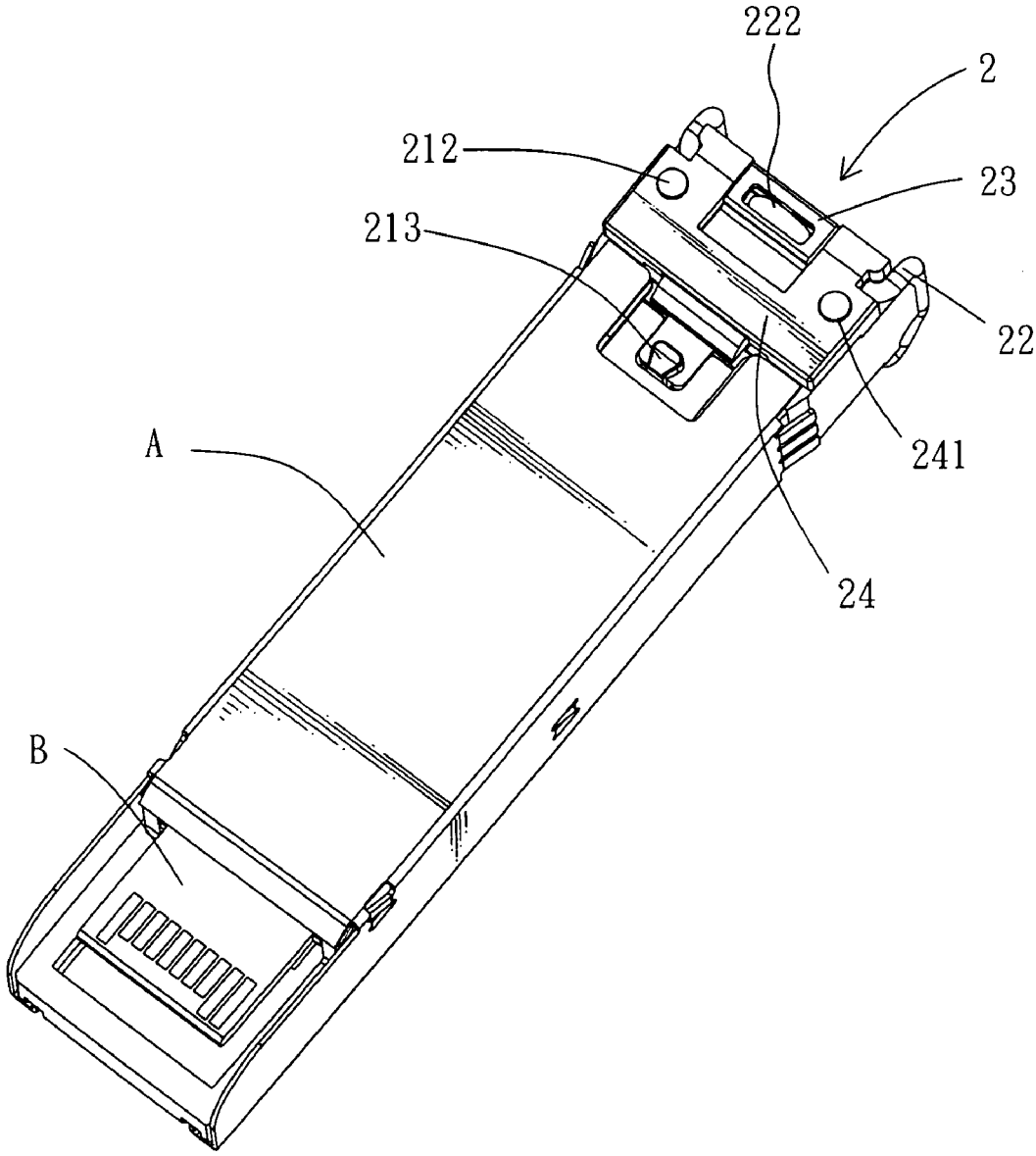
FIG. 2 is an oblique rear elevation of the preferred embodiment of the present invention.
Figure 3:
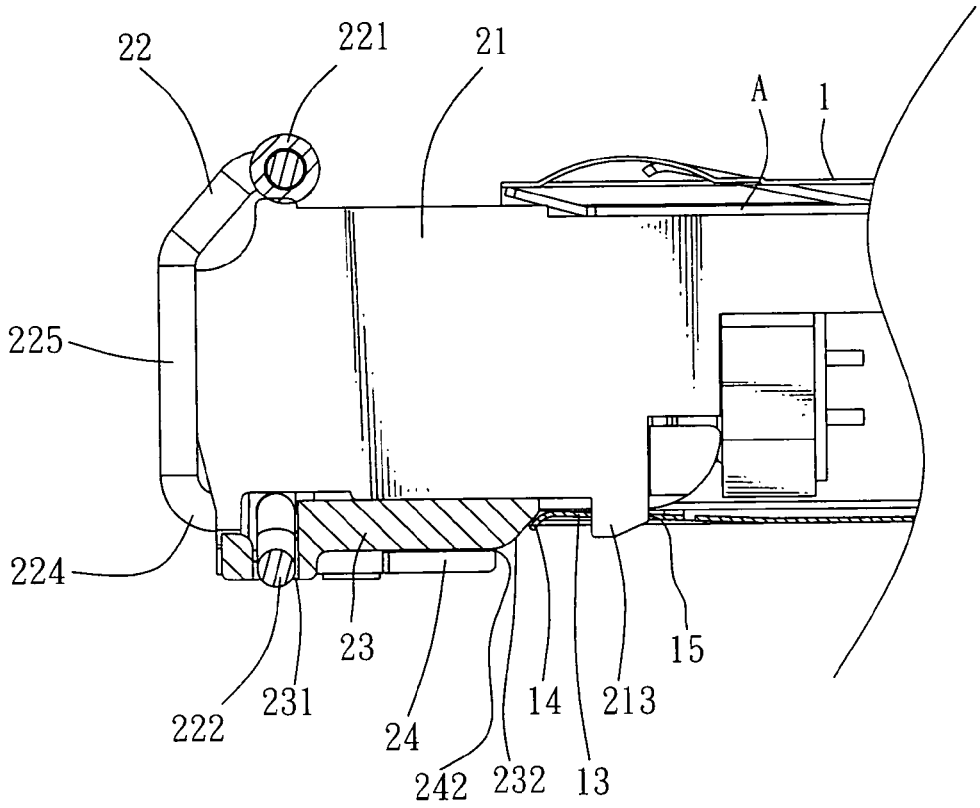
FIG. 3 is a sectional view of the preferred embodiment when locked.

Referring to FIGS. 1~3, a locking/unlocking mechanism for mobile rack in accordance with the present invention is shown comprised of a sleeve member 1 and a sliding member 2.

The sleeve member 1 is a rectangular sleeve insertable into a rectangular box A, comprising a receiving open chamber 11 longitudinally extending through the front and rear sides thereof, a retaining spring plate 13 formed of a part of the bottom panel 12 at the front side of the sleeve member 1 by cutting. The retaining spring plate 13 has a center retaining hole 15 and a front free end terminating in a beveled guide portion 14. After insertion of the sleeve member 1 into the rectangular box A, the retaining spring plate 13 is suspending in front of the rectangular box A.

The sliding member 2 comprises a base 21, a handle 22, a movable holder plate 23, and a locating plate 24. The base 21 has the bottom wall thereof mounted with a circuit board B and a related device C. These attached members are not within the scope of the claims of the present invention. No further detailed description in this regard is necessary.

The base 21 has a bottom groove 211 formed in the bottom wall near the front side and adapted to receive the handle 22, two bottom mounting rods 212 downwardly extending from the bottom wall behind and not far from the bottom groove 211 for the connection of the locating plate 24, and a raised portion 213 protruding from the bottom wall corresponding to the retaining hole 15 of the retaining spring plate 13 and adapted to engage the retaining hole 15 of the retaining spring plate 13 after the sliding member 2 has been received inside the sleeve member 1.

The handle 22 is formed of a round rod by bending, having two horizontal endpieces 226 transversely extending toward each other and joined by a grip 221, a V-shaped protruding portion 222 disposed at the bottom side on the middle, two horizontal rod portions 223 respectively outwardly extending from the two ends of the V-shaped protruding portion 222, two vertical rod portions 225 respectively connected between the endpieces 226 and the horizontal rod portions 223, and two connecting rod portions 224 horizontally extending in longitudinal direction and respectively connected between the horizontal rod portions 223 and the vertical rod portions 225.

The movable holder plate 23 is a flat member having a hole 231 adapted to accommodate the V-shaped protruding portion 222, having a beveled guide portion 232 corresponding to the beveled guide portion 14 of the sleeve member 1 and adapted to match the beveled guide portion 14 of the sleeve member 1 upon insertion of the sliding member 2 into the inside of the sleeve member 1, and a sliding groove 233 adapted to accommodate the horizontal rod portions 223 of the handle 22 and to guide movement of the handle 22.

The locating plate 24 has two mounting holes 241 respectively fastened to the bottom mounting rods 212 of the base 21 of the sliding member 2 by riveting, a chamber 242 adapted to accommodate the movable holder plate 23, two side arms 243 symmetrically disposed at two opposite lateral sides, and two locating grooves 244 respectively formed in the side arms 243 at the top for the positioning of the horizontal rod portions 223 of the handle 22.

Referring to FIGS. 2 and 3 again, after insertion of the sliding member 2 into the sleeve member 1, the raised portion 213 is engaged into the retaining hole 15 of the retaining spring plate 13, and the V-shaped protruding portion 222 is engaged into the hole 231 of the movable holder plate 23.

Figure 4:
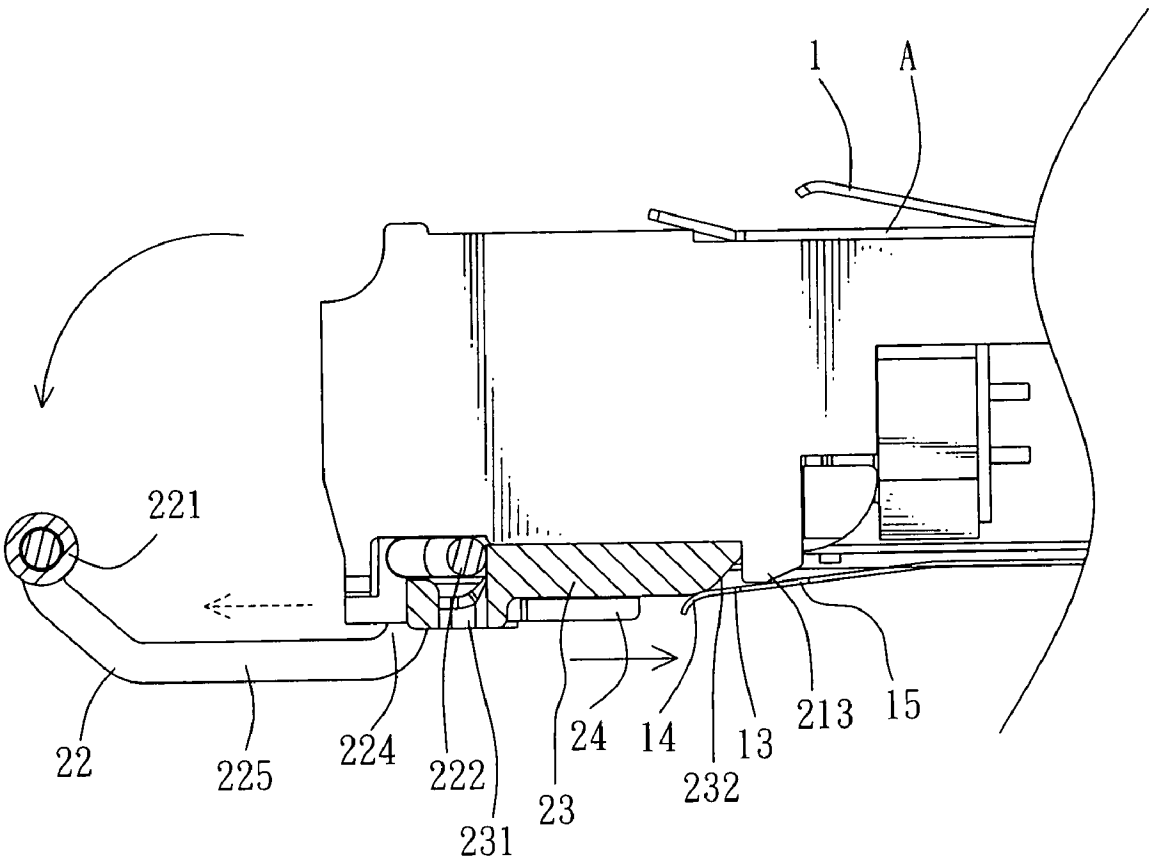
FIG. 4 is a sectional view of the preferred embodiment when unlocked.

Referring to FIG. 4 and FIG. 3 again, when wishing to move the sliding member 2 out of the sleeve member 1, turn the handle 2 downward to force the V-shaped protruding portion 222 forward, thereby causing the raised portion 213 to be disengaged from the retaining hole 15 of the retaining spring plate 13 to unlock the sliding member 2 from the sleeve member 1, and therefore the user can pull the handle 22 to move the sliding member 2 out of the sleeve member 1.

A prototype of locking/unlocking mechanism for mobile rack has been constructed with the features of FIGS. 1~4. The locking/unlocking mechanism for mobile rack functions smoothly to provide all of the features discussed earlier.

Although a particular embodiment of the invention has been described in detail for purposes of illustration, various modifications and enhancements may be made without departing from the spirit and scope of the invention. For example, oscillator means may be used to atomize water into a fine spray. Accordingly, the invention is not to be limited except as by the appended claims.

What is claimed is:

1. A locking/unlocking mechanism for mobile rack, comprising:

a sleeve member, said sleeve member comprising a receiving open chamber longitudinally extending through front and rear sides thereof, and a suspending retaining spring plate disposed at a bottom side thereof, said retaining spring plate having a center retaining hole and a front free end terminating in a beveled guide portion;

a sliding member insertable into the receiving open chamber of said sleeve member, said sliding member comprising a base, a handle, a movable holder plate, and a locating plate, said base having a plurality of bottom mounting rods fastened to said locating plate and a raised portion protruding from a bottom wall thereof and adapted to engage the retaining hole of the retaining spring plate of said sleeve member, said handle having a loop-like shape and a V-shaped protruding portion disposed at a bottom side thereof on the middle, said movable holder plate having a hole adapted to accommodate the V-shaped protruding portion of said handle, a beveled guide portion adapted to match the beveled guide portion of said retaining spring plate of said sleeve member, and a sliding groove adapted to accommodate said handle, said locating plate having two mounting holes respectively fastened to the bottom mounting rods of said base, a chamber adapted to accommodate said movable holder plate, two side arms symmetrically disposed at two opposite lateral sides, and two locating grooves respectively formed in said side arms for the positioning of said handle; and wherein when inserted said sliding member into said sleeve, said raised portion of said base of said sliding member is engaged into the retaining hole of said retaining spring plate of said sleeve member to lock said sliding member to said sleeve member; when the user turned said handle outwardly downwards from said sliding member, said V-shaped protruding portion is forced against said movable holder plate, thereby causing the raised portion of said base of said sliding member to be disengaged from the retaining hole of said retaining spring plate of said sleeve member to unlock said sliding member from said sleeve member.

2. The locking/unlocking mechanism for mobile rack as claimed in claim 1, wherein said retaining spring plate is formed of a part of a bottom wall of said sleeve by cutting.

3. The locking/unlocking mechanism for mobile rack as claimed in claim 1, which is used in a photoelectric converting connector.

4. The locking/unlocking mechanism for mobile rack as claimed in claim 1, wherein said bottom mounting rods of said base of said sleeve member is fastened to the mounting holes of said locating plate by riveting.

* * * * *